US008111853B2

(12) United States Patent
Isvan

(10) Patent No.: US 8,111,853 B2
(45) Date of Patent: Feb. 7, 2012

(54) DUAL MODE EARPHONE WITH ACOUSTIC EQUALIZATION

(75) Inventor: Osman Kemal Isvan, Aptos, CA (US)

(73) Assignee: Plantronics, Inc, Santa Cruz, CA (US)

( * ) Notice: Subject to any disclaimer, the term of this patent is extended or adjusted under 35 U.S.C. 154(b) by 880 days.

(21) Appl. No.: 12/170,716

(22) Filed: Jul. 10, 2008

(65) Prior Publication Data

US 2010/0008528 A1 Jan. 14, 2010

(51) Int. Cl.
*H04R 1/20* (2006.01)

(52) U.S. Cl. ..... 381/337; 381/309; 381/328; 381/338; 381/345; 381/347

(58) Field of Classification Search ..... None
See application file for complete search history.

(56) References Cited

U.S. PATENT DOCUMENTS 6,704,429 B2 * 3/2004 Lin ..... 381/380
7,349,550 B2 * 3/2008 Oliveira et al. ..... 381/380
2002/0080990 A1 * 6/2002 Lin ..... 381/380
2009/0022343 A1 * 1/2009 Van Schaack et al. ..... 381/309
2009/0086159 A1 * 4/2009 Jannard ..... 351/158
2009/0101433 A1 * 4/2009 Stiehl et al. ..... 181/129
2010/0142726 A1 * 6/2010 Donaldson ..... 381/93
2010/0246879 A1 * 9/2010 Siahaan et al. ..... 381/380
2011/0103609 A1 * 5/2011 Pelland et al. ..... 381/74

* cited by examiner

*Primary Examiner* — Marlon Fletcher

(74) *Attorney, Agent, or Firm* — David S. Park; Andre Tacdiran

(57) ABSTRACT

In one embodiment, a dual-mode earphone is provided, comprising a first earbud including a speaker with a diaphragm and at least one acoustic port in front of the diaphragm, and a cap in front of the speaker. The speaker or the cap is configured to move relative to the other for opening and closing the acoustic port in one embodiment and a movable seal is provided in another embodiment. The earphone further includes a second earbud housing operably coupled to the first earbud opposite the speaker. A method for providing acoustic equalization in a dual-mode earphone is also disclosed.

20 Claims, 6 Drawing Sheets

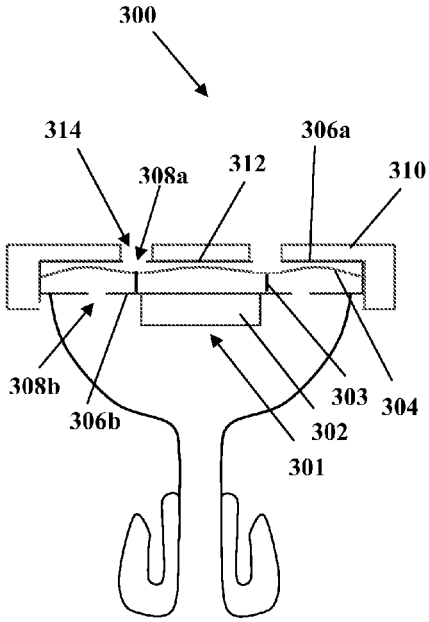
FIG. 3A
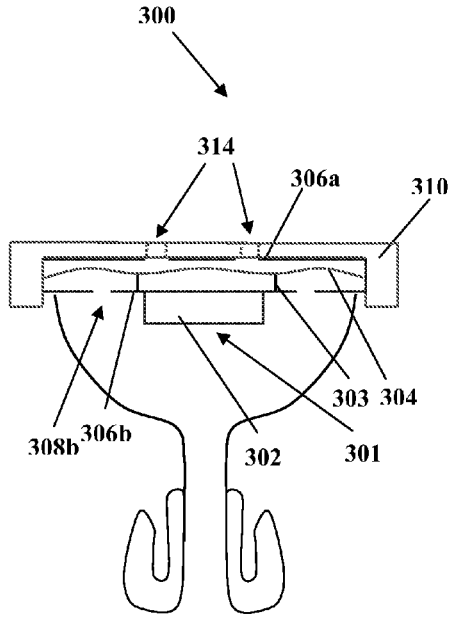
FIG. 3B
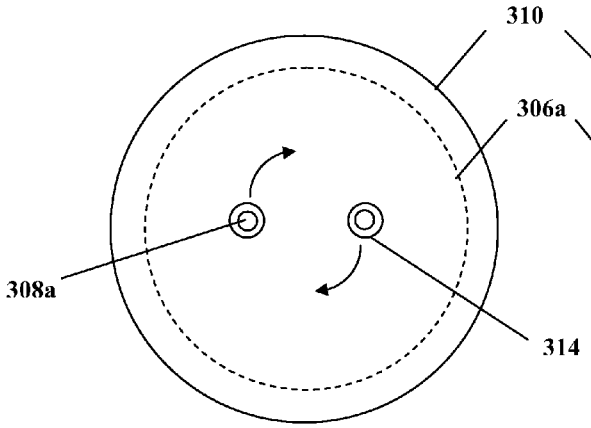
FIG. 3A1
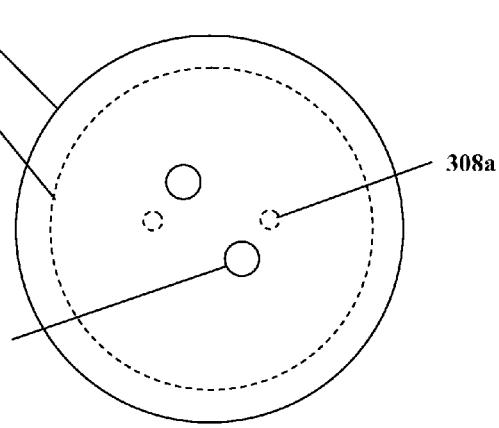
FIG. 3B1

DUAL MODE EARPHONE WITH ACOUSTIC EQUALIZATION

BACKGROUND

1. Field of the Invention

This invention generally relates to earphones and, more particularly, to an "in-the-ear" type of earphone with both a loose-fitting earbud and a canal-occluding earbud.

2. Description of Related Art

One type of earphone, which can incorporate one or two earpieces for monaural or stereo listening, is known as an "in-the-ear" type earphone, which employs an earpiece that fits into the cavum area of a user's ear.

Generally, in-the-ear type earphones can be divided into one of two categories: the loose-fitting category and the canal-occluding category. Loose-fitting earphones typically have larger diameter faceplates that contact the ear and are preferred for comfortable fit and open feel. Canal-occluding earphones (also known as isolation earphones or insert earphones) typically have a smaller form factor for fitting tightly in the ear canal and are preferred for higher sound quality and passive noise reduction. Users choose between these types of earphones depending on their individual needs and priorities.

However, the same person may have different needs at different times and in different situations. For example, one may prefer in an airport the loose-fitting mode to hear announcements but may prefer on the airplane the isolation mode. On other occasions, one might prefer the insert wearing style for its superior sound quality even in a quiet environment. In another example, one may prefer the loose-fitting mode when chewing or running as some people do not like their ears occluded during these activities but are not willing to give up listening to music or to miss handsfree phone calls.

A dual-mode earphone in which each side of a speaker is acoustically coupled to a different type of earbud is known. This type of earphone can work either in isolation mode with a canal-occluding earphone or in loose-fitting mode with a loose-fitting earphone. However, in prior dual-mode earphones, the audio quality has been compromised in one or both of the earbuds due to the lack of acoustic equalization capability.

Therefore, there is a need in the art for a dual-mode earphone that is simple to use and yet provides uncompromised sound quality for both modes of the earphone.

SUMMARY

In accordance with the present invention, apparatus and methods are disclosed for providing acoustic equalization in a dual-mode earphone allowing for uncompromised sound quality in both modes of the earphone.

In one embodiment of the invention, a dual-mode earphone comprises a speaker with a diaphragm and a first earbud including at least one acoustic port operably coupled to the front of the diaphragm, and a cap in front of the speaker. The speaker or the cap is configured to move relative to the other for opening and closing the acoustic port. The earphone further includes a second earbud housing opposite the speaker including at least one acoustic port operably coupled to the back of the diaphragm.

In another embodiment of the invention, dual-mode earphone comprises a speaker with a diaphragm and a first earbud including at least one acoustic port operably coupled to the front of the diaphragm, a cap in front of the speaker, and an adjustable seal operably coupled between the speaker and the cap. The seal is configured to open and close the acoustic port. The earphone further includes a second earbud housing opposite the speaker including at least one acoustic port coupled to the back of the diaphragm.

In yet another embodiment, a method for providing acoustic equalization in a dual-mode earphone is disclosed, the method comprising providing an earphone as described above and adjusting the cap or the speaker to open or close the acoustic port depending upon which of the first earbud or the second earbud housing is to be inserted into a user's ear.

Advantageously, the present invention provides earphones and methods for use with improved audio quality and simple acoustic equalization.

These and other features and advantages of the present invention will be more readily apparent from the detailed description of the embodiments set forth below taken in conjunction with the accompanying drawings.

BRIEF DESCRIPTION OF THE DRAWINGS

FIGS. 3A-3B illustrate sectional views and FIGS. 3A1-3B1 illustrate front views of an earphone including an adjustable twist cap in an open position and a closed position respectively, in accordance with another embodiment of the present invention.

Figures 1A, 1B:
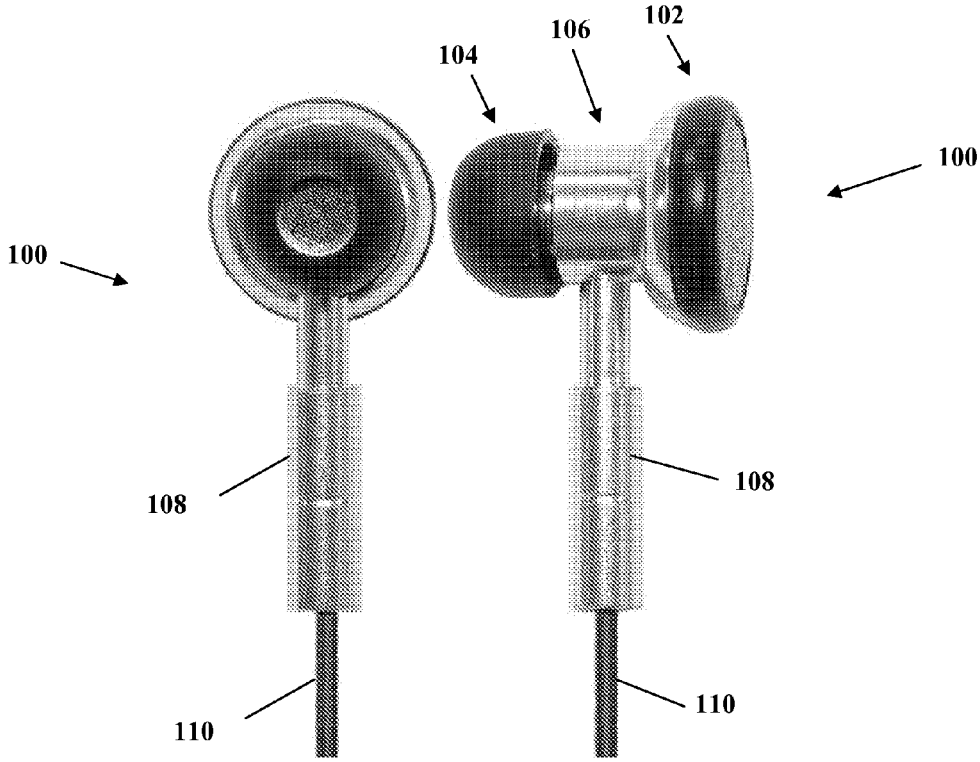
FIGS. 1A-1B illustrate a rear view and a side view, respectively.

Embodiments of the present invention and their advantages are best understood by referring to the detailed description that follows. It should be appreciated that like reference numerals in different figures indicate similar or identical items. It should also be appreciated that the figures may not be necessarily drawn to scale.

DETAILED DESCRIPTION

In all previous solutions known so far, the audio quality of a dual-mode earphone including a loose-fitting earpiece and a canal-occluding earpiece has been compromised because of the combination of two physical phenomena:

1. Whether the ear canal is occluded or un-occluded, the perception of sound always ensues from the acoustic pressure at the ear drum after being filtered by the free-field head-related transfer function (HRTF) of the unoccluded ear;
2. With a canal-occluding earbud, the sound pressure output of the speaker is proportional to the displacement of the speaker diaphragm, whereas in a loose-fitting earbud the sound pressure output of the speaker is proportional to the acceleration of the speaker diaphragm.

With existing dual-mode wearing solutions it is not possible to reconcile these phenomena. For the purpose of explaining this limitation, the operating frequency bandwidth will be divided into low and high frequency regions.

At low frequencies, for example less than about 800 Hz, the free-field HRTF is flat. This means that with insert earphones the speaker diaphragm's displacement must have the desired frequency response; and with loose-fitting earphones the speaker diaphragm's acceleration must have the desired frequency response. Obviously, the frequency response of the acceleration of one side of the diaphragm cannot be the same as the frequency response of the displacement of the other side of the diaphragm.

In other words, if the diaphragm's displacement is expressed as $$x(t)=X\cdot\sin(\omega\cdot t)$$

then the diaphragm's acceleration becomes $$a(t)=\frac{d^2x}{dt^2}=-\omega^2\cdot X\cdot\sin(\omega\cdot t)=-\omega^2\cdot x(t)$$

That is, acceleration and displacement are out-of-phase; and the ratio of acceleration to displacement is equal to the transfer function of a second order high-pass filter.

At high frequencies, for example greater than about 800 Hz and less than about 7 kHz, the free-field HRTF of the unoccluded ear has a peak at approximately 3 kHz due to a resonance of the ear canal. Isolation earphones move this resonance to a higher frequency by occluding the ear canal. Therefore, for isolation earphones the frequency response of the displacement of the speaker diaphragm would preferably have a resonance peak at approximately 3 kHz. However, with loose-fitting earphones, the frequency response of the acceleration of the speaker diaphragm (i.e., that of the sound pressure output of the speaker) would preferably be flat over this frequency region. Obviously, opposite sides of the same diaphragm cannot satisfy both of these conditions.

It is noted that throughout this document, spatially relative terms, such as "in front" and "behind", may be used for ease of description to describe one element or feature's relationship to another element(s) or feature(s) as illustrated in the figures. For example, an acoustic structure "in front" of a speaker diaphragm may be a loose-fitting earbud, and an acoustic structure "behind" the speaker diaphragm may be a canal-occluding earbud. However, the configuration of earbuds may be different in other embodiments, and the perspective from which an element is in front or behind another element may be changed without altering the scope of the present invention. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

In accordance with the present invention, apparatus and methods are disclosed for providing acoustic equalization in a dual-mode earphone, thus allowing for uncompromised sound quality in both modes of the earphone.

Figures 1C, 1D:
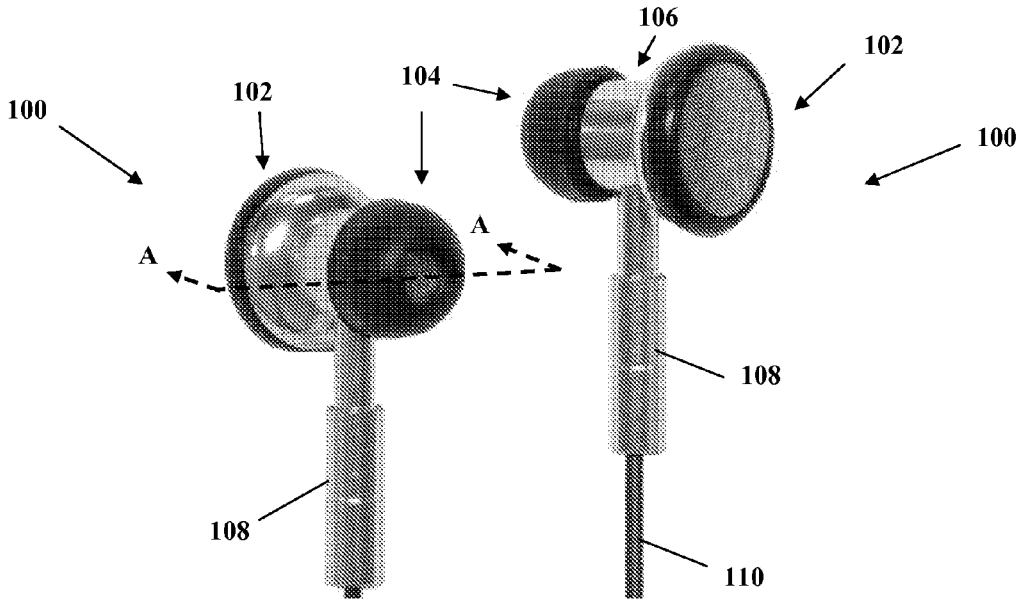
FIGS. 1C-1D illustrate perspective views, of a dual-mode earphone in accordance with an embodiment of the present invention.

Referring now to FIGS. 1A-1B, a rear view and a side view of a dual-mode earphone 100, respectively, are illustrated. FIGS. 1C-1D illustrate perspective views of dual-mode earphone 100. Earphone 100 may be used with an audio source, such as a telephone handset, a cellular phone, a personal computer, a PDA, or a communication network. However, the invention is not limited to receiving a signal from a specific audio source. Furthermore, earphone 100 may be used for either monaural or stereo listening by applying earphone 100 to one or each ear of a user.

In one embodiment, earphone 100 includes a loose-fitting earbud 102 and a canal-occluding earbud housing 104 operably coupled to earbud 102 along an interface 106. The canal-occluding earbud housing may be sized to maximize fit into the recess of the user's ear and may seal to the inner features of the user's ear to block out external noise while directing sound from the transducer to the eardrum. The loose-fitting earbud may have a wider faceplate and fit more loosely and externally to the user's ear canal as compared to the canal-occluding earbud housing. In one example, loose-fitting earbud 102 and canal-occluding earbud housing 104 may have acoustic seal and wearing position characteristics in accordance with the "acoustically open (controlled leakage) intra-concha" type of earphone and the "acoustically closed (minimum leakage) insert" type of earphone, respectively, as defined by the international standard for sound system equipment headphones and earphones, IEC 60268-7.

An internal speaker 201 (FIGS. 2A-2B) is housed within earbud 102 and used for both modes (loose-fitting and canal-occluding) of earphone 100. In one example, the internal speaker is an electro-acoustic speaker that receives audio signals from an audio signal source and may comprise a known type of electromagnetic, piezoelectric, or electrostatic type of driving element, or a combination thereof, or even some other form of driving element, for generating sound waves from the output face of the speaker and toward the cap. It is noted however that various applicable speakers may be used.

Speaker wires operably connect the speaker to an audio source. Speaker wires may extend outside of the earphone housing and can be protected inside a cable 110, which is made from a non-conductive material in one embodiment. Optionally, a cable boot 108 may be operably connected to the interface area between earbud 102 and earbud housing 104 where the cable enters the earphone and surrounds a portion of the cable adjacent to the outside of the earphone. The cable boot may be made from a hard or flexible material in one embodiment and protects the area of the cable just outside of earphone 100 from possible causes of disconnection, such as undesired bending and pulling that might cause a malfunction. The invention is not limited to using the aforementioned materials and the headset body, cable boot, and cable may be made of any protective material, such as rubber or polymer compounds.

Furthermore, a connector at the end of the speaker wires, such as a RJ-11 connector or a 2-3.5 mm plug, may operably connect the headset to an audio source, such as a telephone handset, cellular telephone, or a computer. In other embodiments, the invention may be incorporated in wireless earphones. In yet other embodiments, the dual-mode earphone of the present invention may be used in conjunction with a microphone to enable two-way voice communication by the user. In one example, the microphone may be operably enclosed in a pod below the dual-mode earphone in line with cable 110.

Figure 2A:
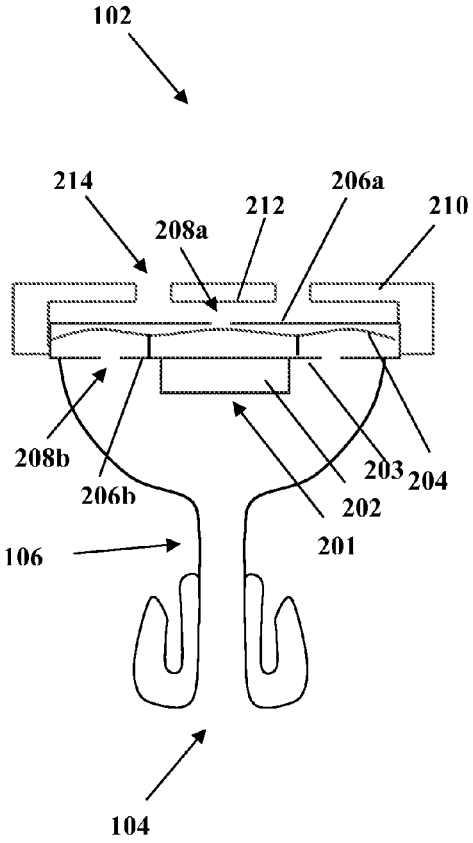
FIGS. 2A-2B illustrate sectional views of the earphone of FIGS. 1A-1D including an adjustable cap in an open position and a closed position, respectively, in accordance with an embodiment of the present invention.
Figure 2B:
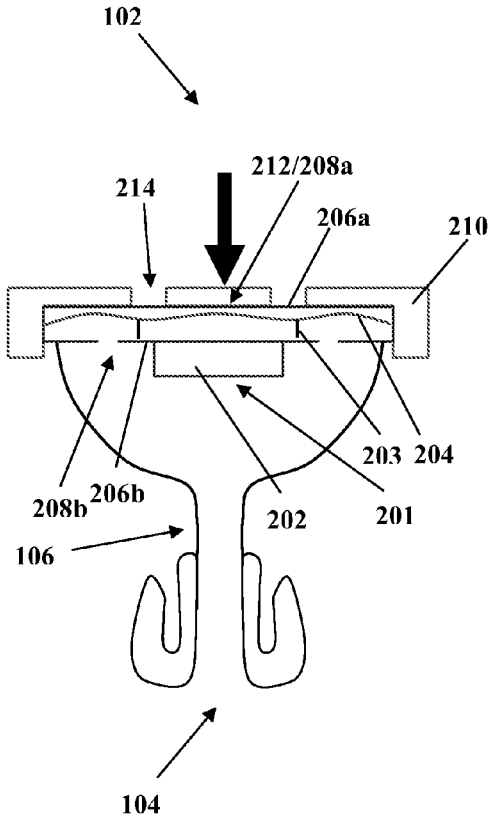

Referring now to FIGS. 2A-2B, sectional views of the dual-mode earphone of FIGS. 1A-1D along a line A-A (FIG. 1C) are illustrated in accordance with an embodiment of the present invention. Loose-fitting earbud 102 includes an adjustable cap 210, having a sealing surface 212 and an acoustic aperture 214, operably coupled in front of a speaker 201. Speaker 201 includes a magnet 202 and a voice coil 203 behind a diaphragm 204 housed between a front cover 206*a* and a back cover 206*b*. The front cover 206*a* includes a front acoustic port 208*a* and the back cover 206*b* includes a back acoustic port 208*b*. In this embodiment, acoustic aperture 214, acoustic port 208*a*, and acoustic port 208*b* are not aligned to be along a straight path but this configuration is not necessarily so, as described in other embodiments below. It is also noted that in some embodiments, the speaker's magnet and coil may be arranged differently, or speaker 201 may not include a magnet or a voice coil.

In accordance with an embodiment of the present invention, adjustable cap 210 is movable between an open position in which acoustic port 208*a* and acoustic aperture 214 are open for providing a pathway for sound (FIG. 2A), and a closed position in which acoustic port 208*a* is sealed against sealing surface 212 and acoustic aperture 214 is sealed against the front cover 206*a* (FIG. 2B). In one example, adjustable cap 210 is movable between an open position and a closed position by sliding means through which cap 210 slides over speaker 201, or screwing means through which cap 210 includes internal threads and speaker 201 includes external threads for screwing or twisting cap 210 between an open position and a closed position.

In the sealed or closed position of the cap, all acoustic ports and apertures in front of diaphragm 204 are sealed and the mechanical impedance is that of the air spring from a small volume of air trapped between the diaphragm 204 and front cover 206*a*. In the low frequency region (less than about 800 Hz), the mechanical impedance presented to the speaker is the compliance of this air spring; therefore the diaphragm displacement has a flat frequency response, and in the high frequency region (more than about 800 Hz and less than about 7 kHz), at some characteristic frequency depending on the effective area of the diaphragm, the trapped air volume and the moving mass of the speaker, the speaker diaphragm resonates with this air spring. This acoustically induced resonance results in a frequency response peak that matches that of the open-ear HRTF (approximately 3 kHz) which would be absent in the occluded ear canal. Thus, in the closed position of the ear cap (FIG. 2B), the structure in front of the speaker functions as an acoustic equalizer and the canal-occluding earbud 104 is optimized as an isolation earphone to be sealed to the ear canal. Passive attenuation is also provided to function as hearing protection in the isolation mode.

In the open or unsealed position of the cap (FIG. 2A), acoustic port 208*a* and acoustic apertures 214 are open for passage of sound waves, and the speaker resonates at a sufficiently low frequency ideal for loose-fitting applications (free-air resonance). Above this frequency (for example about 250 Hz), the mechanical impedance presented to the speaker is its own moving mass, and the diaphragm acceleration therefore has a flat frequency response. The acoustically induced 3 kHz resonance is removed from the speaker because in the loose-fitting wearing style this resonance is present in the unoccluded ear canal. Thus, in the open position of the cap 210, the loose-fitting earbud 102 is optimized as a non-occluding earbud to be inserted in the concha but not sealed to the ear canal.

Accordingly, adjustable cap 210 advantageously functions as an acoustic equalizer and allows the user to experience nearly the same frequency response in either wearing style as when the earbuds are separately manufactured.

Referring now to FIGS. 3A-3B and 3A1-3B1, sectional views and front views of a headset 300 (similar to sectional views taken along a line A-A in FIG. 1C for example) are illustrated in accordance with another embodiment of the present invention. Cap 310 is movably coupled to speaker 301 such that acoustic apertures 314 are aligned with acoustic ports 308*a* in the open or unsealed position and not aligned in the closed or sealed position.

Similar to the embodiment described above with respect to FIGS. 2A-2B, a loose-fitting earbud of earphone 300 includes an adjustable cap 310, having a sealing surface 312 and an acoustic aperture 314, operably coupled in front of a speaker 301. Speaker 301 includes a magnet 302 and a voice coil 303 behind a diaphragm 304 housed between a front cover 306*a* and a back cover 306*b* (again it is noted that in some embodiments, speaker 301 may not include a magnet or a voice coil). The front cover 306*a* includes a front acoustic port 308*a* and the back cover 306*b* includes a back acoustic port 308*b*.

As noted above, in this embodiment, acoustic aperture 314 and acoustic port 308*a* are aligned in the open position and not aligned in the closed position to thereby seal the acoustic ports and apertures in front of the diaphragm. Adjustable cap 310 is movable between an open position in which acoustic port 308*a* and acoustic aperture 314 are open for providing a pathway for sound (FIGS. 3A and 3A1), and a closed position in which acoustic port 308*a* is sealed against sealing surface 312 and acoustic aperture 314 is sealed against the front cover 306*a* (FIGS. 3B and 3B1). In one example, adjustable cap 310 is movable between an open position and a closed position by twisting cap 310 over speaker 301 such that apertures 314 and ports 308*a* are moved between an aligned position (FIG. 3A) and an un-aligned position (FIG. 3B1).

Similar to the embodiment described above, in the sealed or closed position of the cap, all acoustic ports and apertures in front of diaphragm 304 are sealed and the structure in front of the speaker functions as an acoustic equalizer and the canal-occluding earbud is optimized as an isolation earphone to be sealed to the ear canal.

In the open or unsealed position of the cap, acoustic port 308*a* and acoustic apertures 314 are open for passage of sound waves, and the speaker resonates at a sufficiently low frequency ideal for loose-fitting applications (free-air resonance). Thus, in the open position of the cap 310, the loose-fitting earbud is optimized as a non-occluding earbud to be inserted in the concha but not sealed to the ear canal.

Accordingly, adjustable cap 310 advantageously functions as an acoustic equalizer and allows the user to experience nearly the same frequency response in either wearing style as when the earbuds are separately manufactured.

Figure 4A:
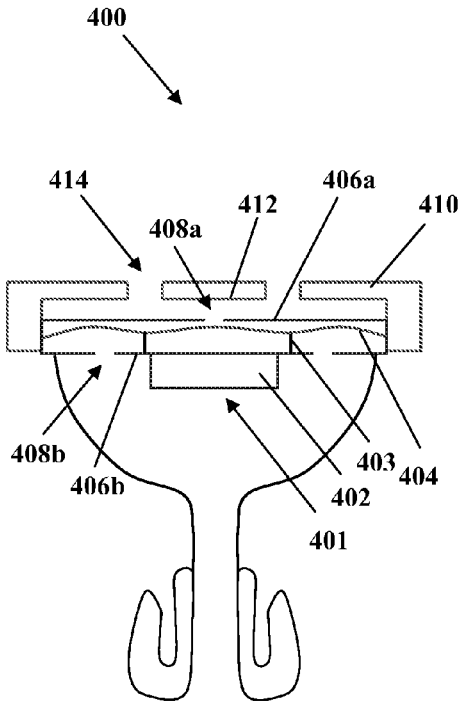
FIGS. 4A-4B illustrate sectional views of an earphone including an adjustable speaker in an open position and a closed position, respectively, in accordance with another embodiment of the present invention.
Figure 4B:
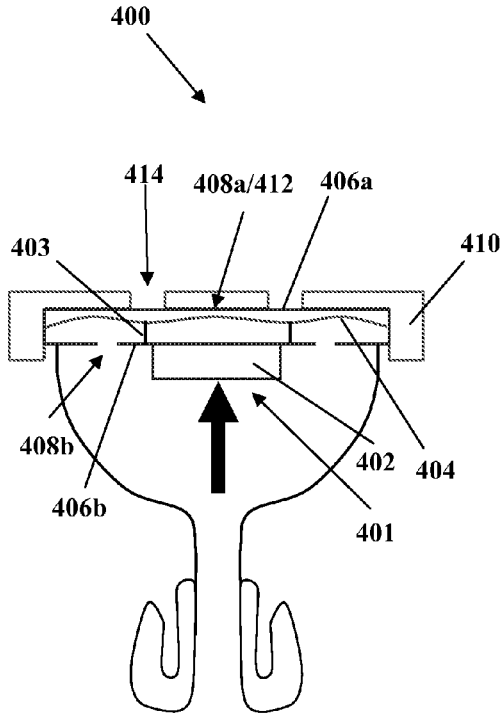

Referring now to FIGS. 4A-4B, sectional views of a headset 400 (similar to sectional views taken along a line A-A in FIG. 1C for example) are illustrated in accordance with another embodiment of the present invention. In this embodiment, cap 410 is fixed relative to the housing but speaker 402 is movable, and the opening and closing of the ports and apertures may be otherwise similar to the previous embodiment described above with respect to FIGS. 2A-2B. A loose-fitting earbud includes a fixed cap 410, with a sealing surface 412 and an acoustic aperture 414, operably coupled in front of an adjustable speaker 401. Adjustable speaker 401 includes a magnet 402 and a coil 403 behind a diaphragm 404 housed between a front cover 406*a* and a back cover 406*b* (again it is noted that in some embodiments, speaker 401 may not include a magnet or a voice coil). Front cover 406*a* includes an acoustic port 408*a* and back cover 406*b* includes an acoustic port 408*b*.

In accordance with an embodiment of the present invention, adjustable speaker 401 is movable between an open position in which acoustic port 408*a* and acoustic aperture 414 are open for passage of sound (FIG. 4A), and a closed position in which acoustic port 408*a* is sealed against sealing surface 412 and acoustic aperture 414 is sealed against front cover 406*a* (FIG. 4B). In a preferred embodiment of the invention, speaker 402 may be a dynamic speaker, and may be movable by various means and methods, such as a button actuator or an electric motor.

Similar to the embodiment described above, in the sealed or closed position of the cap, all acoustic ports and apertures in front of diaphragm 404 are sealed and the structure in front of the speaker functions as an acoustic equalizer and the canal-occluded earbud is optimized as an isolation earphone to be sealed to the ear canal.

In the open or unsealed position of the cap, acoustic port 408*a* and acoustic apertures 414 are open for passage of sound waves, and the speaker resonates at a sufficiently low frequency ideal for loose-fitting applications (free-air resonance). Thus, in the open position of the cap 410, the loose-fitting earbud is optimized.

Accordingly, adjustable speaker 401 advantageously functions as an acoustic equalizer and allows the user to experience nearly the same frequency response in either wearing style as when the earbuds are separately manufactured.

Figure 5A:
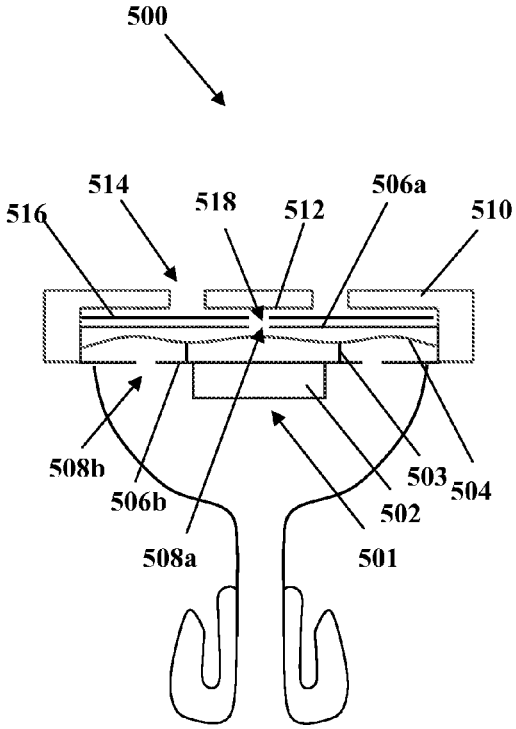
FIGS. 5A-5C illustrate sectional views of an earphone including a movable seal in an open position and a closed position, respectively, in accordance with another embodiment of the present invention.
Figure 5B:
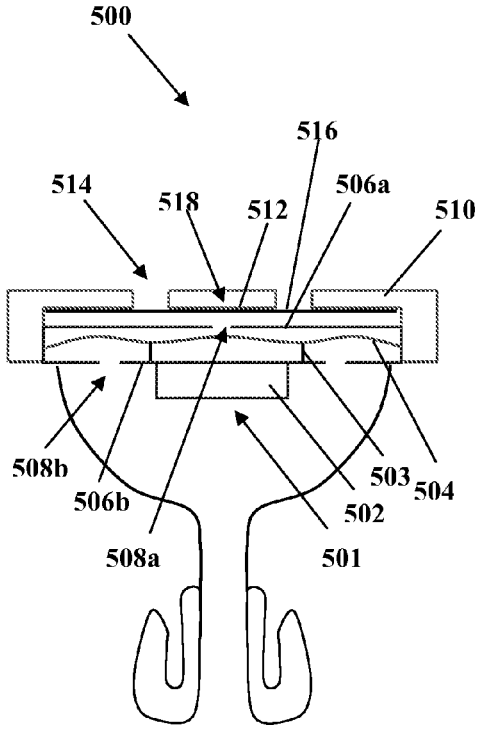
Figure 5C:
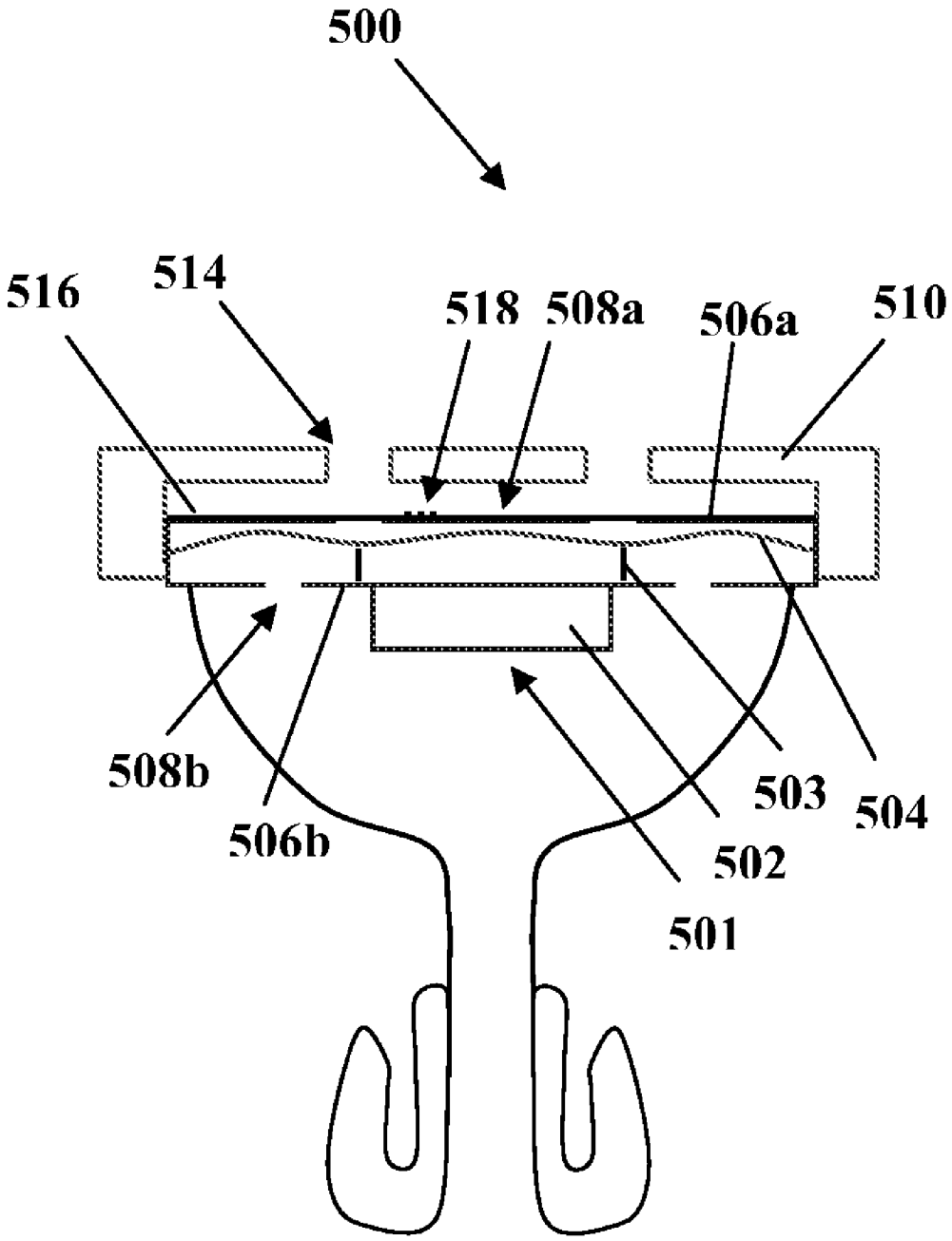

Referring now to FIGS. 5A-5C, sectional views of a headset 500 (similar to sectional views taken along a line A-A in FIG. 1C, for example) are illustrated in accordance with another embodiment of the present invention. In this embodiment, cap 510 and speaker 501 may be fixed and a separate movable seal 516 may be operably coupled between cap 510 and speaker 501. A loose-fitting earbud includes a fixed cap 510, with a sealing surface 512 and an acoustic aperture 514, operably coupled in front of an adjustable speaker 501. Speaker 501 includes a magnet 502 and a coil 503 behind a diaphragm 504 housed between a front cover 506*a* and a back cover 506*b* (again it is noted that in some embodiments, speaker 501 may not include a magnet or a voice coil). Front cover 506*a* includes an acoustic port 508*a* and back cover 506*b* includes an acoustic port 508*b*. In this embodiment, seal 516 includes an aperture 518 aligned with acoustic port 508*a*.

In accordance with an embodiment of the present invention, adjustable seal 516 is movable between an open position in which acoustic port 508*a* and acoustic aperture 514 are open for passage of sound (FIG. 5A), and a closed position in which acoustic aperture 514 is sealed (FIG. 5B) by moving seal 516 against sealing surface 512 of cap 510. Acoustic port 508*a* may remain open in this embodiment. It is noted that in other embodiments, acoustic port 508*b* may be sealed and acoustic aperture 514 left open in the closed position of seal 516 by not having the aperture of seal 516 aligned with acoustic port 508*a* and moving seal 516 against front cover 506*a* (FIG. 5C). In yet other embodiments, both the acoustic ports 508*a* and apertures 514 may be sealed by having seal 516 tightly fit between cap 510 and speaker 501 and including seal apertures 518 which are not aligned with the ports or apertures when the seal is moved to the closed position. In yet other embodiments, the seal may include a plurality of apertures aligned with both the acoustic apertures and acoustic ports in the open position, and unaligned apertures in the closed position to seal both the acoustic apertures and the acoustic ports. Seal 516 may be movable by various means and methods, such as a twistable or slidable plate (including apertures) between the cap and speaker.

Thus, in the sealed or closed position of the seal, some (or all) acoustic ports and/or apertures in front of diaphragm 504 are sealed and the structure in front of the speaker functions as an acoustic equalizer and the canal-occluded earbud is optimized as an isolation earphone to be sealed to the ear canal.

In the open or unsealed position of the seal, acoustic port 508*a* and acoustic apertures 514 are open for passage of sound waves, and the speaker resonates at a sufficiently low frequency ideal for loose-fitting applications (free-air resonance). Thus, in the open position of the seal, the loose-fitting earbud is optimized as a non-occluding earbud to be inserted in the concha but not sealed to the ear canal.

Accordingly, the adjustable seal 516 advantageously functions as an acoustic equalizer and allows the user to experience nearly the same frequency response in either wearing style as when the earbuds are separately manufactured.

Advantageously, the present invention discloses a single earphone that provides high comfort with one wearing mode and high performance with another wearing mode. Furthermore, the present invention optimizes both modes of a dual-mode earphone with a simple acoustic equalizer that allows the user to experience nearly the same frequency response in either wearing style as when the earbuds are separately manufactured. Thus, the earphone of the present invention may provide the best possible acoustic quality (e.g., bass response) with both wearing styles and the user can choose a wearing style relatively independent from an acoustic response. For example, the present invention allows the user to select a wearing style based on comfort, ambient noise isolation, stability, and appearance instead of sound quality.

The above-described embodiments of the present invention are merely meant to be illustrative and not limiting. It will thus be obvious to those skilled in the art that various changes and modifications may be made without departing from this invention in its broader aspects. For example, different configurations and numbers of apertures of the cap and ports of the speaker covers are possible without departing from the scope of the present invention. Therefore, the appended claims encompass all such changes and modifications as falling within the true spirit and scope of this invention.

I claim:

1. A dual-mode earphone, comprising:

a first earbud including:

a speaker with a diaphragm and at least one acoustic port in front of the diaphragm, and a cap in front of the speaker, the speaker or the cap configured to move relative to the other for opening and closing the acoustic port; and a second earbud housing operably coupled to the first earbud opposite the speaker.

2. The earphone of claim 1, wherein the first earbud is a loose-fitting earbud and the second earbud housing is a canal-occluding earbud housing.

3. The earphone of claim 1, wherein the cap is adjustable and configured to open and close the acoustic port against a surface of a fixed speaker.

4. The earphone of claim 1, wherein the cap is adjustable via screwing means or sliding means.

5. The earphone of claim 1, wherein the cap includes at least one aperture and at least one sealing surface that can substantially seal the acoustic port.

6. The earphone of claim 5, wherein the at least one aperture is aligned with the acoustic port or not aligned with the acoustic port.

7. The earphone of claim 1, wherein the speaker is adjustable and configured to open and close the acoustic port against a surface of a fixed cap.

8. The earphone of claim 1, wherein the speaker includes at least one acoustic port behind the diaphragm and in front of the second earbud housing.

9. The earphone of claim 1, wherein the speaker and the cap are both adjustable relative to one another.

10. A dual-mode earphone, comprising:

a first earbud including:

a speaker with a diaphragm and at least one acoustic port in front of the diaphragm, a cap in front of the speaker, and an adjustable seal operably coupled between the speaker and the cap, the seal configured to open and close the acoustic port; and a second earbud housing operably coupled to the first earbud opposite the speaker.

11. The earphone of claim 10, wherein the first earbud is a loose-fitting earbud and the second earbud housing is a canal-occluding earbud housing.

12. The earphone of claim 10, wherein the seal is adjustable via screwing means or sliding means.

13. The earphone of claim 10, wherein the cap includes at least one aperture which can be closed by the seal.

14. The earphone of claim 13, wherein the at least one aperture is aligned with the acoustic port or not aligned with the acoustic port.

15. The earphone of claim 10, wherein the speaker includes at least one acoustic port behind the diaphragm and in front of the second earbud housing.

16. A method for providing acoustic equalization in a dual-mode earphone, the method comprising:

providing a dual-mode earphone, including:

a first earbud having a speaker with a diaphragm and at least one acoustic port in front of the diaphragm, and a cap in front of the speaker, and a second earbud housing operably coupled to the first earbud opposite the speaker; and adjusting the cap or the speaker to open or close the acoustic port depending upon which of the first earbud or the second earbud housing is to be inserted into a user's ear.

17. The method of claim 16, further comprising opening the acoustic port when the first earbud is to be inserted or closing the acoustic port when the second earbud housing is to be inserted.

18. The method of claim 16, wherein adjusting the cap includes turning the cap or sliding the cap.

19. The method of claim 16, wherein adjusting the cap to close the acoustic port includes interfacing a sealing surface on the cap with the acoustic port.

20. The method of claim 16, further comprising transmitting sound through the first earbud via the acoustic port in front of the diaphragm or transmitting sound through the second earbud housing via an acoustic port behind the diaphragm.

* * * * *